US005889275A

United States Patent [19]

Chen

[11] Patent Number: 5,889,275

[45] Date of Patent: Mar. 30, 1999

[54] VERSATILE WATER SPRAYER

[76] Inventor: Shui-Shang Chen, P.O. Box 55-175, Taichung, Taiwan

[21] Appl. No.: 998,704

[22] Filed: Dec. 29, 1997

[51] Int. Cl.[6] ..... A62C 31/02

[52] U.S. Cl. ..... 239/391; 239/437; 239/587.1; 239/588

[58] Field of Search ..... 239/390.3, 396, 239/397, 436, 437, 442, 451, 525, 526, 552, 587.1, 587.2, 587.3, 587.4, 588; 4/615

[56] References Cited

U.S. PATENT DOCUMENTS

| | | | |
|---|---|---|---|
| 4,674,687 | 6/1987 | Smith et al. | 239/587.4 |
| 5,090,624 | 2/1992 | Rogers | 239/525 |
| 5,613,638 | 3/1997 | Blessing | 239/396 |
| 5,667,146 | 9/1997 | Pimentel et al. | 239/587.4 |
| 5,765,760 | 6/1998 | Kuo | 239/437 |

*Primary Examiner*—Andres Kashnikow
*Assistant Examiner*—Lisa Ann Douglas
*Attorney, Agent, or Firm*—Harrison & Egbert

[57] ABSTRACT

A versatile water sprayer is provided. The sprayer includes a tubular handle connecting one end to a water source and the other end to an universal adapter which is composed of a plurality of coarse surfaced hollow joints and connected at the other end with an atomizer which either has a plurality of different sized water passages at a forward surface or a plurality of tangential nozzles in lateral periphery. So that this sprayer is characterized in that the water can be sprayed forward in selective mount or adjustably sprayed laterally over a large area such as a garden or green pastures. The universal adapter is flexible to be bent toward multi-directions.

13 Claims, 7 Drawing Sheets

VERSATILE WATER SPRAYER

BACKGROUND OF THE INVENTION

The present invention relates to sprayer and/or atomizer apparatus and more particularly to a versatile water sprayer which is rotatable and flexible so as to twist to multi-directions.

Typical water sprayer (as shown in FIG. 1) includes generally a bent pipe 1 and an atomizer 2 releasably connected with the pipe 1 which in turn connects to a water source. The atomizer 2 includes a perforated forward surface 3 from which the water spurts out. Other types of the water sprayer include a tubular handle which connects on one end to the atomizer and the other end to a hose. The handle is bent according to the ergonomics so as to facilitate the handle grip of the user. Because these types of the water sprayers have their solid structure, they are difficult to spray upward unless the water will wet the user himself. Besides, they can not rotate to spray the water to a large area such as a garden or a pastures, they are limited in use.

SUMMARY OF THE INVENTION

The present invention has a main object to provide a versatile water sprayer which includes a convertible atomizer suitable to spray the water to multi-directions.

Another object of the present invention is to provide a versatile water sprayer which includes an universal adapter to provide more flexibility to the sprayer so that the sprayer can be bent to any direction relative to the user in order to be suitable to any surface to which the water sprays.

Further object of the present invention is to provide a versatile water sprayer in which the atomizer is rotatable to suite to spray the water to a large area such as a garden or a pastures.

The present invention will become more fully understood by reference to the following detailed description thereof when read in conjunction with the attached drawings.

DETAILED DESCRIPTION OF THE PREFERRED EMBODIMENT

Figure 1:
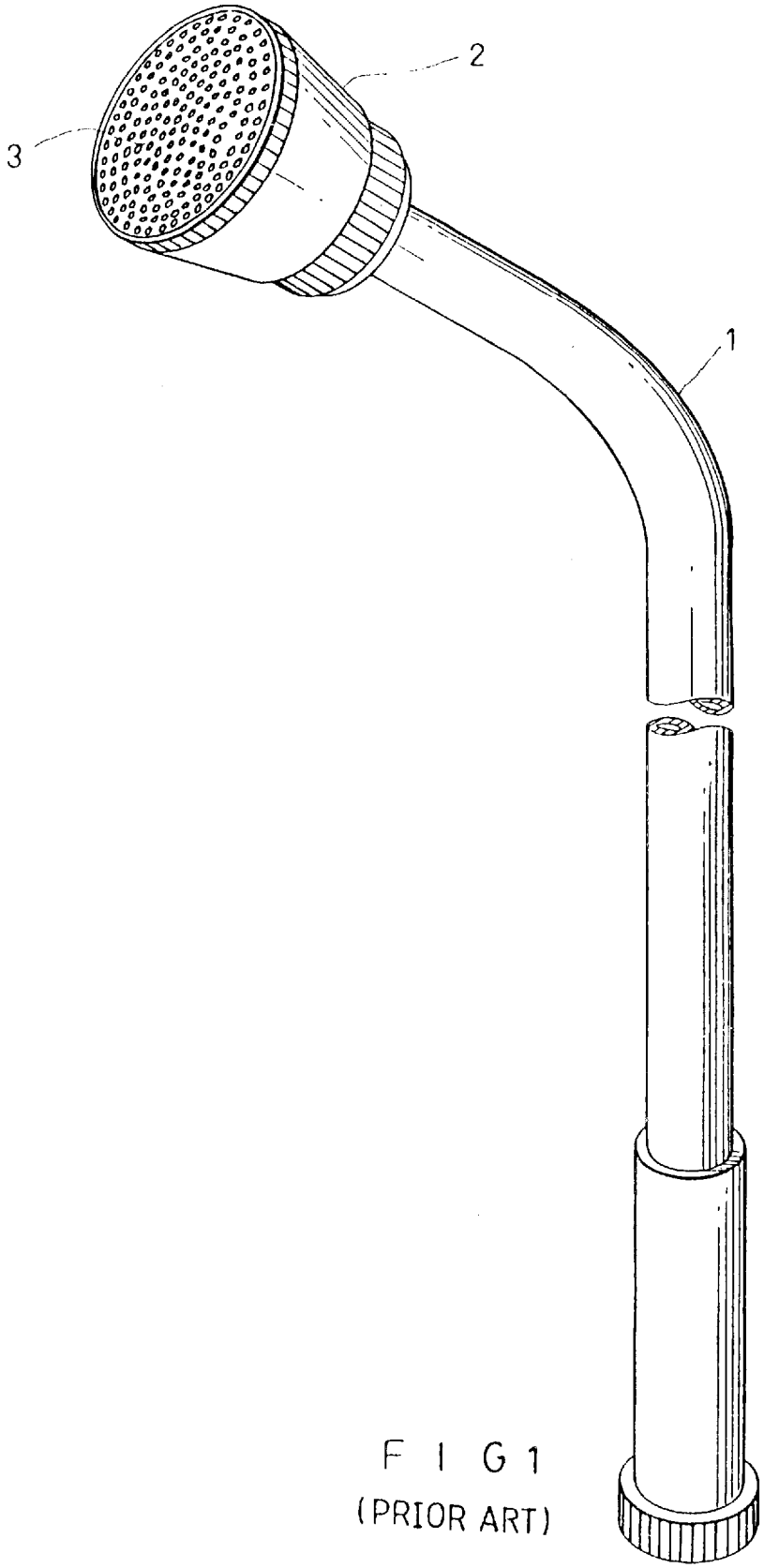
FIG 1 (PRIOR ART)
FIG. 1 is a perspective view to show a water sprayer according to the prior art.
Figure 2:
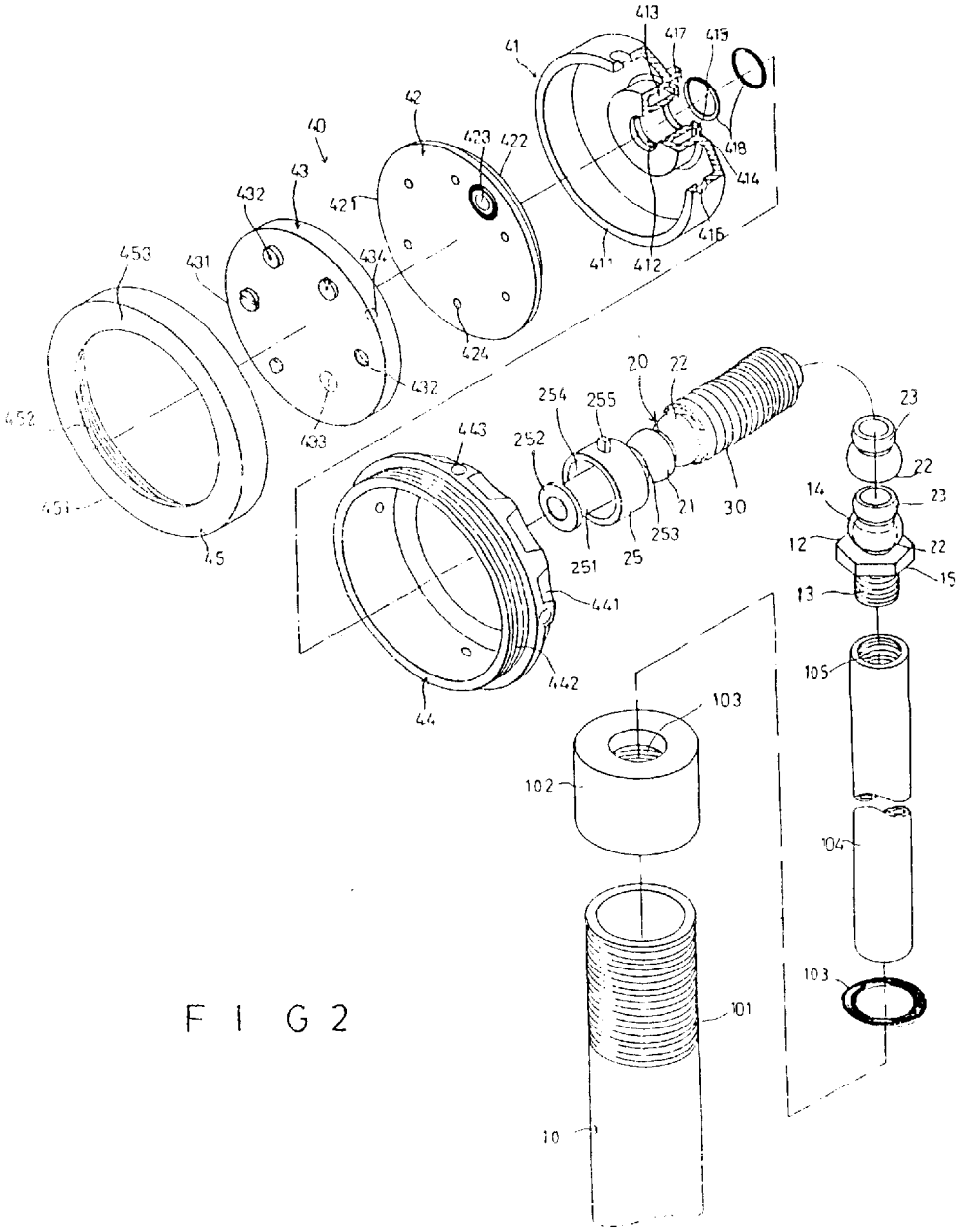
FIG. 2 is an exploded perspective view to show a preferred embodiment according to the present invention.
Figure 3:
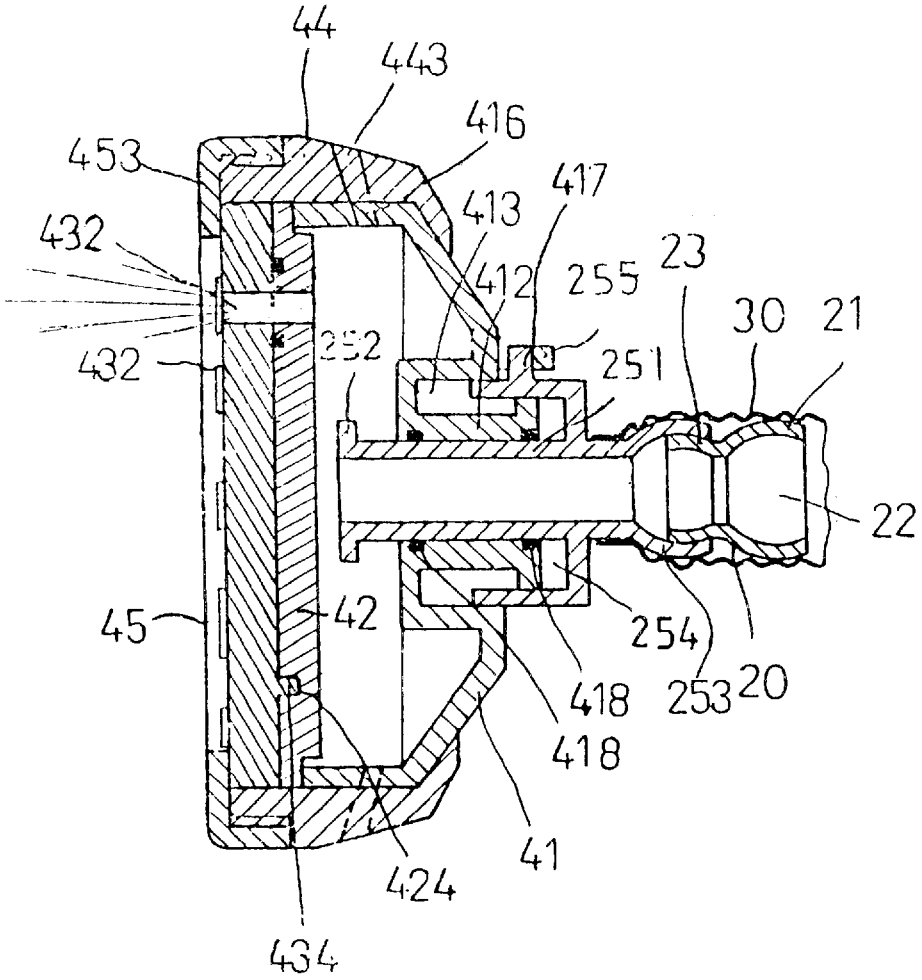
FIG. 3 is a sectional view to show an assembled water sprayer of the present invention.

With reference to FIG. 2 of the drawings, the versatile water sprayer of the present invention comprises generally a tubular handle 10 which has one end connected to a water source such as a hose or a spout and the other end including a threaded outer periphery 101 made in registry with a threaded inner periphery 103 of a nut 102 which has a central bore in the bottom, an elongate pipe 104 which has an outer diameter equal to the inner diameter of the tubular handle 10 so as to be engageable into the handle 10 with a sealing ring engaged therebetween and fastened by the nut 102 and a threaded inner periphery adjacent a free end made in registry with a threaded outer periphery 13 of a first tubular connector 12 which includes a hollow spherical means 14 above a hexagon 15, an universal adapter 20 composed of a plurality of coarse surfaced hollow joints 21 each of which includes a large diameter hemispherical casing 22 and a small diameter hemispherical casing 23 joined with one another in the manner such that each of the small diameter hemispherical casings 23 engages into the large diameter hemispherical casing 22 of an adjacent joint 21 and confined within a flexible means 30 which may be corrugated hose or other suitable means with the rearmost one of the hollow joints 21 rotatably connected to the first tubular connector 12 and the foremost thereof connected to a second tubular connector 25 which is composed of tubular body 251, a retaining ring 252 releasably fixed to the forward end of the body 251, a hollow hemispherical portion 253 extended from the rearward end thereof for engaging with a small diameter hemispherical casing 23 of the flexible adapter 20 (as shown in FIG. 3), an annular ring 254 of L-shaped section laterally extended outward from an outer periphery of the body 251 adjacent the hemispherical portion 253 and a projection 255 centrally projected outward from an outer periphery of the annular ring 254, and an atomizer 40 rotatably connected with second tubular connector 25. The atomizer 40 is composed of a hollow tapered seat 41, a positioning disc 42, a shifting disc 43, a rotatable ring 44 and a fastening cap 45. The hollow tapered seat 41 includes a protrudent central bore 412 of a diameter equal to the diameter of the tubular body 251 so as to be rotatably wrapped on the body 251, an annular gap 413 surrounding the central bore 412 including an annular flange 415 around a rearward opening 414 for receiving partially the annular ring 254 therein, a plurality of first tangential nozzles 416 centrally formed spaced apart around the circumferential wall 411 and a hook means 417 extended rearward from a bottom of the seat 41 and engageable with the projection 255 of the second tubular connector 25. When the tubular body 251 of the tubular connector 25 inserts into the central bore 412 of the seat 41, a pair of sealing rings 418 are disposed therebetween. The positioning disc 42 includes a flat circular body 421 of the diameter equal to the outer diameter of the seat 41, a stepped portion 422 of the diameter equal to the inner diameter of the seat 41 so that the positioning disc 42 is engageable into the rim of the seat 41 (as shown in FIG. 3), a first water passage 423 formed through a flat surface adjacent a circumferential edge and a plurality of positioning cavities 424 formed spaced apart around the flat surface adjacent the circumferential edge thereof. The shifting disc 43 includes a flat circular body 431, a plurality of second water passages 432 of different sizes formed spaced apart around the flat surface and selectively engageable with the first water passage 423 of the positioning disc 42 for discharging different amount of water, among which is a blockage 433 for blocking the first water passage 423, and a positioning rod 434 projected rearward from an opposite side of the flat circular body 431. The positioning rod 434 is selectively engageable into any one of those positioning cavities 424 of the positioning disc 42 for preventing the shifting disc 43 from rotation. The rotatable ring 44 includes an introrse contracted rear portion 441 engageable with the tapered portion of the seat 41 so that the ring 44 is retainable by the seat 41, a peripheral thread 442 around a forward portion and a plurality of second tangential nozzles 443 formed spaced apart around the contracted rear portion 441 engageable with the first tangential nozzles 416 of the seat 41. The fastening cap 45 includes an annular body 451, a threaded inner periphery 452 engageable with the thread 442 of the rotatable ring 44, and an annular flange 453 extended inward from the forward edge thereof for prevent the discs 42 and 43 from breaking away.

FIG. 3 shows a well assembled versatile water sprayer of the present invention. It is understood that the rotatable ring 44 has to engage with the hollow tapered seat 41 at first from the rearside of the seat 41 so that the introrse contacted rear portion 441 is engaged with outer surface of the tapered seat 41 and is retained by the seat 41. Then inserts the tubular body 251 of the second tubular connector 25 into the central bore 412 of the seat 41 with the pair of sealing rings 418 fixed therebetween, where the L-shaped annular ring 254 partially inserts into the annular gap 413 through the opening 414 having its inner surface contacting the annular flange 415 and the projection 255 is prevented by the hook means 417 from longitudinal movement or lateral rotation and fixed by the retaining ring 252 at the free end of the body 251. Next step is sequentially and axially mounting the positioning disc 42 and shifting disc 43 into the rotatable ring 44 and abutting the rim of the seat 41 and then fasten the fastening cap 45 onto the rotatable ring 44. So that the shifting disc 43 is rotatable inside the atomizer 40 but is retained by the cap 45 from breaking away. However, if the hook means 417 disengages with the projection 255, the atomizer 40 can move longitudinally or rotate laterally. FIG. 2 also shows that one of the second water passage 432 of the shifting disc 43 engages with the first water passage 423 of the positioning disc 42 and the shifting disc 43 is fixed as its positioning rod 434 engages into one of the positioning cavities 424 in the positioning disc 42, the water is therefore spraying out of the first water passage 423. If shifts the shifting disc 43 clockwise or counterclockwise to have the blockage 433 engaged with the first water passage 423, the water will no longer sprays forward from atomizer 40.

Figure 4:
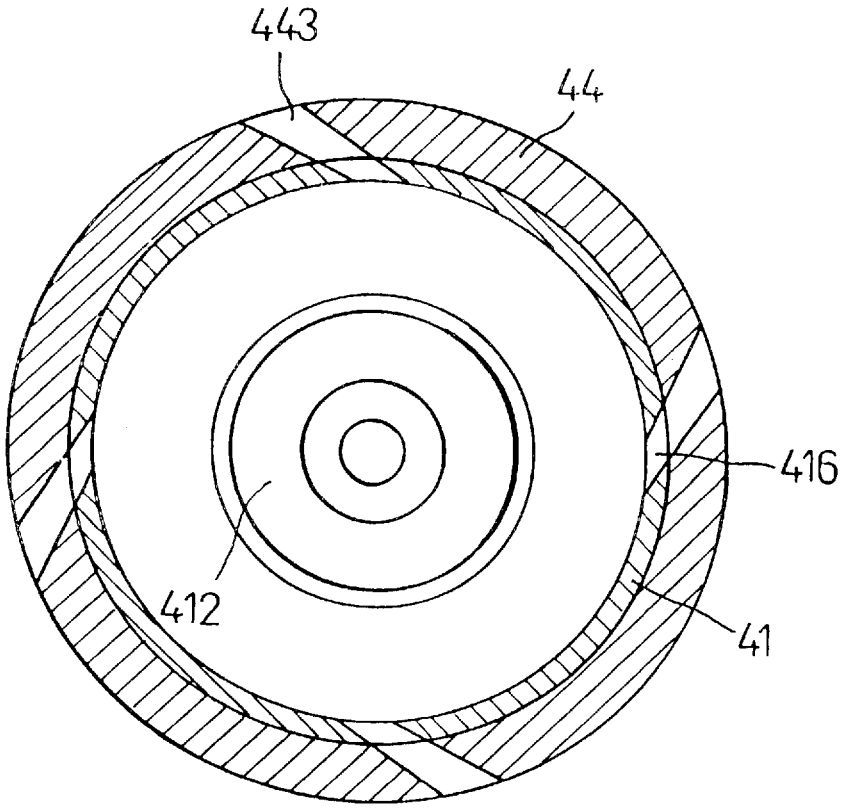
FIG. 4 is a front view of FIG. 3 indicating the forward nozzles at their engaged position.
Figure 5:
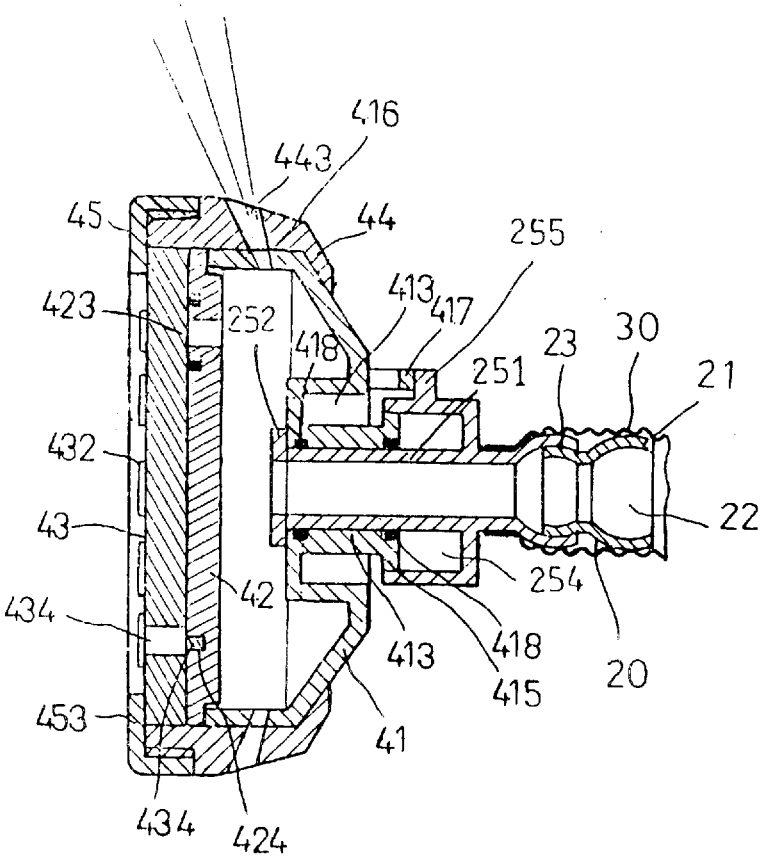
FIG. 5 is a sectional view indicating the side nozzles at their engaged position.
Figure 7:
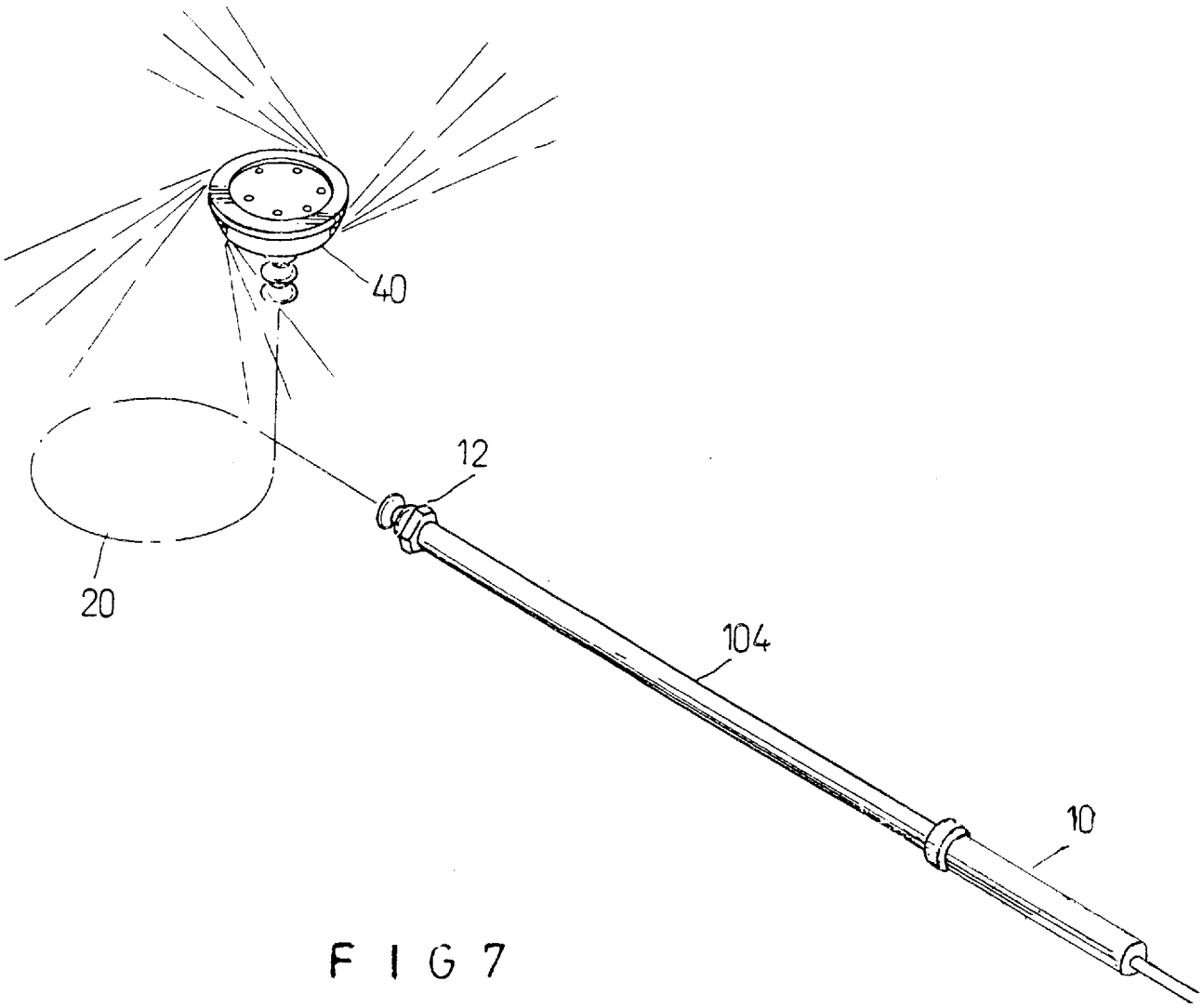
FIG. 7 is a perspective view indicating that the atomizer is rotating to spray the water over a large area of the ground.

Referring FIGS. 4 and 5, it shows that the first tangential nozzles 416 are engageable with the second tangential nozzles 443 by rotating the rotatable ring 44 and the first water passage 423 is blocked out together with the disengagement of the hook means 417, so that the water sprays laterally from the engaged tangential nozzles 416 and 443. Because of the water pressure and the tangential acceleration, the rotatable ring 44 is rotating so as to constantly spray the water therearound. This arrangement facilitate the atomizer 40 spraying the water to larger area such as a garden of a pastures. This time, the user can put the handle 10 on a ground and bend the universal adapter 20 upward as shown in FIG. 7 to have the atomizer 40 toward upward. After a certain area becomes watery, then moves the sprayer to another area. It is very convenient.

Figure 8:
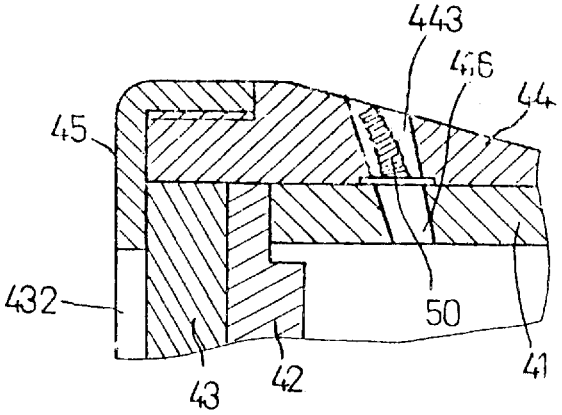
FIG. 8 is a sectional view indicating that a side nozzle is blocked by a disturbing tube.

FIG. 8 shows a disturbing tube 50 disposed into the tangential nozzles 416 and 443. The disturbing tube 50 is fixible to facilitate the user adjusting spraying direction.

Figure 6:
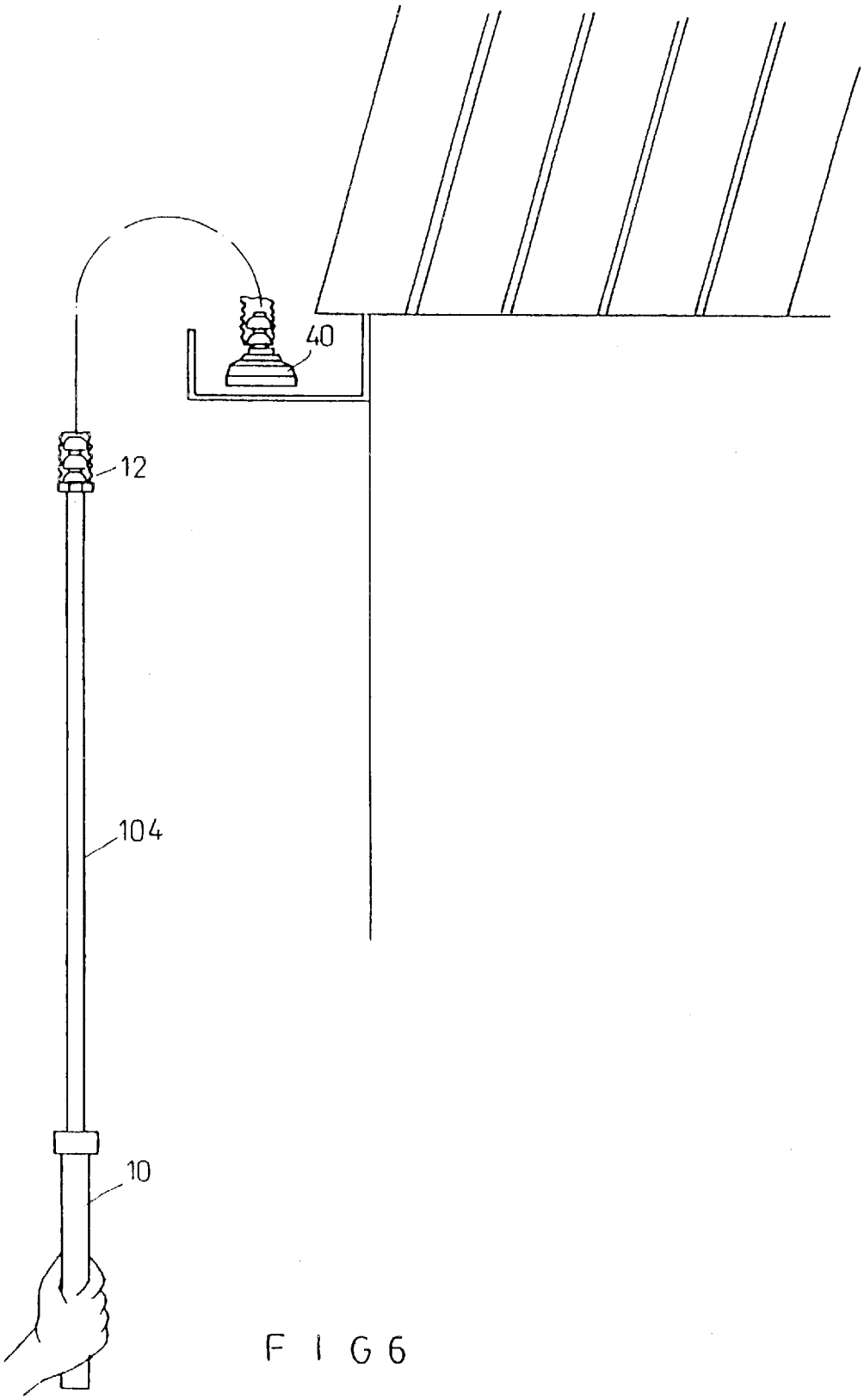
FIG. 6 is an elevational view to show that the universal adapter is bent to facilitate sprayer of the present invention toward downward suitable to clean a trough along the eaves of the roof.

FIG. 6 shows that the universal adapter 20 is bent to a U-shaped having the atomizer 40 toward downward, in addition to the elongate pipe 104, the user can grip the handle 10 at the upper surface of any object at highplace such as trough of a roof, etc.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A versatile water sprayer comprising:

a tubular handle having threaded outer periphery adjacent one end thereof and the other end connecting to a water source;

a nut having a central bore in a bottom and threads on an inner periphery made in registry with the threaded outer periphery of said handle;

an elongate pipe of a diameter equal to the inner periphery of said handle so as to insert into said handle with a sealing therebetween and fastened by said nut and having a threaded inner periphery adjacent a free end thereof;

a first hollow interior connector having a threaded outer periphery abutting lower end made in registry with the threaded inner periphery of said elongate pipe for engaging axially said connector with said elongate pipe, and a hollow spherical means at an upper portion above a hexagon at a center thereof;

an universal adapter having on one end coupled with the hollow sperical means of said first hollow interior connector and the other end connecting to a second hollow interior connector;

an atomizer movably connected with said second hollow interior connector;

whereby, said sprayer can spray water toward multi-directions and rotatable to spray the water over a large area.

2. A sprayer as recited in claim 1 wherein said universal adapter is composed of a plurality of hollow joints rotatably connected together and confined by a flexible wrapper.

3. A sprayer as recited in claim 2 wherein said hollow joints each includes a large hemispherical casing integral with a small diameter hemispherical casing toward opposite side relative to the large hemispherical casing.

4. A sprayer as recited in claim 2 wherein said flexible wrapper is a corrugated hose.

5. A sprayer as recited in claim 2 wherein said hollow joint has a coarse surface.

6. A sprayer as recited in claim 1 wherein said second hollow interior connector has one end rotatably coupled with said universal adapter and other end movably connected with said atomizer.

7. A sprayer as recited in claim 5 wherein said second hollow interior includes a tubular body, a hemispherical portion integral with rearward end engageable with a small hemispherical casing of said universal adapter, an annular ring of L-shaped section laterally extended outward from an outer periphery adjacent the rear end, a projection projected outward from an outer periphery and a retaining ring releasably secured to the forward end of said tubular body thereof.

8. A sprayer as recited in claim 1 wherein said atomizer is composed of a hollow tapered seat, a positioning disc, a shifting disc, a rotatable ring and a fastening cap.

9. A sprayer as recited in claim 8 wherein said hollow tapered seat includes an enclosed side wall, a protrudent central bore for axially engaging with the tubular body of said second hollow interior connector with a pair of sealing rings fixed therebetween and a retaining ring releasably secured at free end of the tubular body, annular gap formed around the central bore including an annular flange around a rearward opening of the gap for receiving partially the annular ring of said tubular body, a hook means projected rearward from a bottom of said seat and a plurality of first tangential nozzles centrally formed spaced apart around the side wall.

10. A sprayer as recited in claim 8 wherein said positioning disc includes a flat circular body of a diameter equal to the outer diameter of said seat, a stepped rear portion of a diameter equal to the inner diameter of the seat so as to be engageable within forward edge of the seat, a water passage formed through a flat surface adjacent a circumference thereof and a plurality of positioning cavities formed spaced apart on the flat surface adjacent the circumference thereof.

11. A sprayer as recited in claim 8 wherein said shifting disc includes a flat circular body equal to that of the positioning disc so as to rotatably engage with the positioning disc, a plurality of second water passages of different size formed in registry with the first water passage of said positioning disc and a blockage means formed among the second water passages and engageable with the first water passage of the positioning disc, and a positioning rod projected outward from a rear side engageable with the cavities of said positioning disc.

12. A sprayer as recited in claim 8 wherein said rotatable ring includes an introrse contracted rear portion engageable with the tapered outer surface of said seat, a threaded outer periphery on forward portion and plurality of second tangential nozzles made spaced apart around peripheral wall made in registry with the first tangential nozzles of said seat.

13. A sprayer as recited in claim 8 wherein said fastening cap includes an annular body, a threaded inner periphery made in registry with the threaded outer periphery of said rotatable ring so as to fasten to the ring and an inwardly extended annular flange for retaining said positioning disc and said shifting disc inside said rotatable ring when it is fastened thereon.

* * * * *